US011284725B2

(12) United States Patent
Moss

(10) Patent No.: US 11,284,725 B2
(45) Date of Patent: Mar. 29, 2022

(54) INFLATABLE MATTRESS BUMPER SYSTEM

(71) Applicant: Daniel Moss, North Salt Lake, UT (US)

(72) Inventor: Daniel Moss, North Salt Lake, UT (US)

( * ) Notice: Subject to any disclaimer, the term of this patent is extended or adjusted under 35 U.S.C. 154(b) by 157 days.

(21) Appl. No.: 15/793,827

(22) Filed: Oct. 25, 2017

(65) Prior Publication Data

US 2018/0110342 A1 Apr. 26, 2018

Related U.S. Application Data

(60) Provisional application No. 62/451,970, filed on Jan. 30, 2017, provisional application No. 62/412,498, filed on Oct. 25, 2016.

(51) Int. Cl.

| | |
|---|---|
| ***A47C 21/08*** | (2006.01) |
| ***A47G 9/02*** | (2006.01) |
| ***A47C 27/08*** | (2006.01) |
| ***A47C 31/10*** | (2006.01) |
| *A47G 9/00* | (2006.01) |

(52) U.S. Cl.

CPC ..... *A47C 21/08* (2013.01); *A47C 27/082* (2013.01); *A47C 31/105* (2013.01); *A47G 9/0246* (2013.01); *A47G 2009/003* (2013.01)

(58) Field of Classification Search

CPC ..... A47C 21/08; A47C 31/105; A47C 27/082; A47G 9/0246; A47G 2009/003

See application file for complete search history.

(56) References Cited

U.S. PATENT DOCUMENTS

| | | | | |
|---|---|---|---|---|
| 4,286,344 | A * | 9/1981 | Ikeda | A47C 21/08 5/420 |
| 4,872,228 | A | 10/1989 | Bishop | |
| 5,421,044 | A | 6/1995 | Steensen | |
| 6,859,961 | B1 * | 3/2005 | Barr | A47C 21/08 5/424 |
| 6,971,132 | B2 | 12/2005 | Feinsod | |
| 7,107,635 | B2 * | 9/2006 | Henry | A47G 9/02 5/424 |
| 7,155,766 | B1 | 1/2007 | Gilchrest, Jr. et al. | |
| 7,380,302 | B2 * | 6/2008 | Gilchrest, Jr | A61G 7/0504 5/710 |
| D612,655 | S * | 3/2010 | Holmstedt | D6/604 |

(Continued)

FOREIGN PATENT DOCUMENTS

| | | | | |
|---|---|---|---|---|
| GB | 868320 A * | 5/1961 | | A47C 21/08 |

*Primary Examiner* — Eric J Kurilla

(74) *Attorney, Agent, or Firm* — Workman Nydegger

(57) ABSTRACT

A mattress guard with one or more inflatable bumpers to prevent patients or older adults from accidentally rolling out of or falling out of bed, and also to avoid the patients or older adults from being trapped in hard/rigid bed rails. A mattress cover includes a fitted mattress sheet, one or more inflatable bumpers, and an air pump system to inflate and deflate the one or more bumpers. At least one of the bumpers has a length and a position that optimizes safety and allows for common user movements without requiring deflation of the bumper. A dual pump system may include primary pump with higher inflation rate to initially inflate one or more bumpers and a secondary pump with lower inflation rate and/or that is quieter to maintain inflation of the bumper(s). An alert system can provide alerts to relatives or staff if a patient is endangered.

19 Claims, 4 Drawing Sheets

(56) References Cited

U.S. PATENT DOCUMENTS

| | | | | |
|---|---|---|---|---|
| 7,735,171 | B2 | 6/2010 | Kan | |
| 7,904,977 | B1 | 3/2011 | Singh | |
| 7,954,186 | B2 | 6/2011 | Flick | |
| 9,101,224 | B2 * | 8/2015 | Chiang | A47C 27/10 |
| D851,425 | S * | 6/2019 | Clute | D6/601 |
| 2012/0011651 | A1 * | 1/2012 | Moss | A47C 21/08 5/424 |
| 2014/0115862 | A1 * | 5/2014 | Sommer | A47C 21/08 29/428 |
| 2014/0173825 | A1 | 6/2014 | Chiang et al. | |
| 2014/0208520 | A1 | 7/2014 | Totton et al. | |
| 2015/0182033 | A1 * | 7/2015 | Brosnan | A47C 27/082 5/706 |
| 2015/0245717 | A1 | 9/2015 | Edmonson | |
| 2016/0000229 | A1 * | 1/2016 | Edmondson | A47C 21/08 5/425 |
| 2016/0007774 | A1 * | 1/2016 | Kakabeeke | A47G 9/0246 5/496 |
| 2016/0242562 | A1 * | 8/2016 | Karschnik | A47C 27/083 |
| 2017/0007036 | A1 * | 1/2017 | Scarleski | A47C 21/028 |
| 2017/0130728 | A1 * | 5/2017 | Liu | F04B 49/022 |
| 2017/0290440 | A1 * | 10/2017 | Haynes | A47C 21/08 |

* cited by examiner

INFLATABLE MATTRESS BUMPER SYSTEM

CROSS-REFERENCE TO RELATED APPLICATIONS

This application claims the benefit of U.S. Provisional Application No. 62/451,970, filed Jan. 30, 2017, and U.S. Provisional Application No. 62/412,498, filed Oct. 25, 2017, the disclosures of which are incorporated herein in their entirety.

BACKGROUND

Patients or older adults often suffer from medical or mobility issues, which can make it difficult for them to roll or turn while lying down or to lift themselves out of bed after lying down. In many cases, they risk falling out of bed while trying to roll over, turn around, or get in/out of bed. Bed rails or side rails are designed to prevent a patient or an older adult from rolling out of bed. Such bed rails are typically bolted to a bed frame or attached to a bed carriage to help prevent falling or rolling out of bed. These rails are typically made of metal, wood, plastic, or other hard/rigid material.

While beneficial, such bed rails have limitations. In some cases, patients or older adults may become trapped against hard bed railings due to medical or mobility issues. Data compiled by the consumer agency from death certificate and hospital emergency room visits from 2003 through May 2012 show that 150 (mostly older) adults died after they became trapped by bed railings. Over nearly the same time period, 36,000 mostly older adults—about 4,000 a year—were treated in emergency rooms with bed rail-related injuries. Officials at the FDA and the commission have concluded that the data probably understated the problem since bed rails are not always listed as a cause of death by nursing homes and coroners or as a cause of injury by emergency room doctors.

Due to such safety concerns, some care facilities have banned traditional bed rails and/or place mattresses of their clients on the floor to avoid the use of bed rails altogether. However, many of those who are in the facility will have great difficulty getting into and out of bed when the bed is positioned so low to the ground.

SUMMARY

Disclosed herein is a mattress or mattress cover having one or more inflatable guards/bumpers configured to prevent a patient or older adult from rolling out of bed, and also to prevent the patient or older adult from being trapped in and injured by conventional bed rails. In some embodiments, the one or more inflatable guards include one or more inflatable bumpers and an air pump system which inflates or deflates the one or more bumpers. At least one of the bumpers is optimally disposed so as to allow for effective user mobility, access, and/or positioning without sacrificing or eliminating effective safety functions.

In some embodiments, a guard system is configured for use with a mattress and comprises (1) a fitted sheet having a top edge, a bottom edge, and opposing side edges, wherein the top edge is positionable at a head of a matress, the bottom edge is positionable at the foot of the matress, and the side edges are positionable along respective sides of the matress; and (2) one or more inflatable bumpers each positioned along a side edge, wherein at least one inflatable bumper has a length that is less than a full length of the corresponding side edge, and wherein the inflatable bumper is placed in a midsection of the side edge to form a top opening between a topmost extension of the inflatable bumper and the top edge of the fitted sheet and/or to form a bottom opening between a bottommost extension of the inflatable bumper and the bottom edge of the fitted sheet.

In some embodiments, a guard system comprises: (1) a cover having opposing side edges; (2) one or more inflatable bumpers each positioned along a side edge; and (3) a pump system operatively coupled to the one or more inflatable bumpers to enable adjustment of inflation levels of the one or more inflatable bumpers. the pump system can include: (a) a primary pump having relatively greater flow capacity and being configured for relatively rapid inflating and deflating of the one or more inflatable bumpers; and (b) a secondary pump having relatively lower flow capacity and being configured for substantially maintaining an inflation level of the one or more inflatable bumpers.

In some embodiments, a safety mattress comprises a top edge, a bottom edge, and opposing side edges and one or more inflatable bumpers integrally formed within the mattress and each positioned along a side edge, wherein at least one inflatable bumper has a length that is less than a full length of the corresponding side edge, and wherein the inflatable bumper is placed in a midsection of the side edge to form a top opening between a topmost extension of the inflatable bumper and the top edge of the fitted sheet and/or to form a bottom opening between a bottommost extension of the inflatable bumper and the bottom edge of the fitted sheet.

In some embodiments, a pump system configured for attachment to an inflatable object comprises: (1) a primary pump having relatively greater flow capacity and being configured for relatively rapid inflating and deflating of the one or more inflatable bumpers; and (2) a secondary pump having relatively lower flow capacity and being configured for substantially maintaining an inflation level of the one or more inflatable bumpers.

BRIEF DESCRIPTION OF THE DRAWINGS

In order to describe the manner in which the above-recited and other advantages and features can be obtained, a more particular description of various embodiments will be rendered by reference to the appended drawings. Understanding that these drawings depict only sample embodiments and are not, therefore, to be considered to be limiting of the scope of the invention, the embodiments will be described and explained with additional specificity and detail through the use of the accompanying drawings in which.

DETAILED DESCRIPTION

Figure 1:
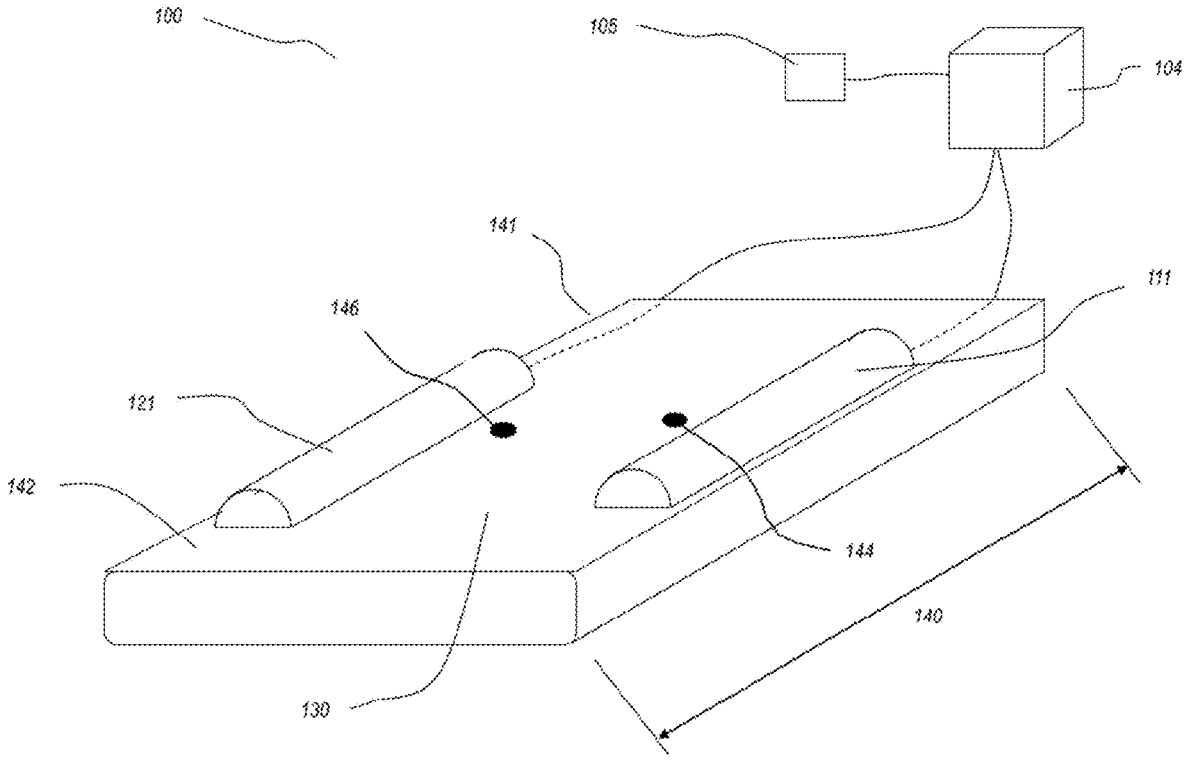
FIG. 1 illustrates an exemplary embodiment of a mattress cover/guard having inflatable bumpers optimally positioned to provide user protection while simultaneously allowing for desirable user movements without the need to deflate the bumpers.

At least some embodiments described herein relate to a mattress or mattress cover having one or more inflatable guards/bumpers to prevent patients or older adults from rolling out of bed, and also to prevent the patients or older adults from being trapped in and injured by bed rails. In some embodiments, the one or more inflatable guards include one or more inflatable bumpers and an air pump system which inflates or deflates the one or more bumpers. At least one of the bumpers is optimally disposed so as to allow for effective user mobility, access, and/or positioning without sacrificing or eliminating effective safety functions.

Although many of the examples described herein relate to embodiments for protecting patients or older adults from falling or being trapped, it will be understood that the same principles and concepts may be applied to other applications, such as applications involving children, special needs individuals, injury recovery, home use, or persons having intellectual and/or developmental disabilities, for example.

In one embodiment, at least one inflatable guard is shorter than the full length of a mattress upon which the mattress cover is sized and shaped to be positioned. For example, the at least one shorter bumper is placed in a middle section along the length of the mattress, leaving openings or passageways at both top and bottom portions along the side of the mattress. The top opening allows the user to access objects near the bed (e.g., reach a nightstand, alarm clock, telephone, help button, bed adjustment control, etc.) without needing to deflate the bumper. In addition, the bottom opening allows the user to pivot his/her legs around to sit up on the bed and/or to get off the bed. These and other actions may be performed without deflating the bumper. The bumper therefore remains in place along the midsection of the edge of the mattress cover in an inflated condition, providing protection from accidental rollovers and falls while also providing a soft and safe padding arrangement that reduces the risk of a user getting stuck or trapped against it (as can occur with conventional rigid bed rails).

Some embodiments described herein include an electric pump system, which includes a control that can control each of the one or more bumpers independently. In one embodiment, the control further includes a sensor for at least one of the bumpers. The sensor senses the air pressure of the bumper. Based on the detected air pressure, the electric pump may be activated or deactivated to inflate or deflate the bumper as required to maintain a desired pressure. In one embodiment, changes in air pressure detected by the sensor may be used to determine whether the user is in contact with one or more bumpers.

At least some embodiments described herein also include a sheet upon which the one or more bumpers are disposed. The sheet may be configured to be positioned upon a mattress as a fitted sheet. For example, the fitted sheet may include one or more fastening mechanisms, which may be selected from a group comprising buckles across one or more corners, elastic straps across one or more corners, hook and loop fasteners across one or more corners, and drawstrings across one or more corners. In an alternative embodiment, the fitted sheet is a mattress cover with a zipper along a side of the mattress that encloses the mattress completely.

FIG. 1 illustrates a perspective view of a mattress guard/cover 100 fitted for placement on the top side of a mattress. The mattress cover 100 includes a fitted mattress sheet 130, bumpers 111 and 121, and an air pump system 104 with control 105. In some embodiments, the fitted mattress sheet 130 has a longitudinal pocket along each side edge for each of the inflatable bumpers 111 and 121. The one or more bumpers 111 and 121 are configured for placement within the longitudinal pockets. In alternative embodiments, the one or more bumpers 111 and 121 are integrally built into the structure of the cover. At least one of the bumpers is shorter than the full length 140 of the long side of the mattress, which creates openings 141 and 142 disposed respectively at the top of the bed and the bottom of the bed. The air pump 104 system is operatively connected to the bumpers 111 and 121. The air pump includes a control 105 for controlling inflation and deflation of the bumpers 111 and 121. In some embodiments, each bumper is independently inflatable and deflatable.

In an example embodiment, a mattress cover having inflatable bumpers may be utilized in conjunction with an alternating pressure mattress. Although the illustrated embodiment includes bed bumpers that are coupled with a cover or sheet-like structure, other embodiments may include bumpers that are coupled directly to a mattress or pad-like structure. For example, some embodiments may include an alternating pressure mattress having one or more integrally attached inflatable bumpers. Many users who could benefit from the bumpers (e.g., for safety reasons and/or prevention of falls) are also at risk of developing bedsores, and would therefore additionally benefit from the functionality of an alternating pressure mattress.

In the illustrated embodiment, each side edge may include a bumper. Each bumper 111 and 121 extends along a midsection of the corresponding side edge, but does not extend to the head of the bed, thereby defining a top opening 141 at the head of the bed between the top edge of the bed and the topmost extent of the corresponding bumper. In this embodiment, each bumper 111 and 121 also extends along the side edge of the bed toward the foot of the bed, but does not extend completely to the foot of the bed, thereby defining a bottom opening 142 at the foot of the bed between the bottom edge of the bed and the bottommost extension of the corresponding inflatable bumper.

Various combinations of bumper arrangements are possible. For example, some embodiments may include a first bumper disposed along a first side edge that extends across substantially all of the side edge, and a second bumper disposed along a portion of a second side edge so as to leave a top and/or a bottom opening, such as those described above. In other embodiments, both a first bumper and a second bumper are configured to define a top opening and/or a bottom opening. In preferred embodiments, at least one bumper is configured and disposed so as to provide both a top opening and a bottom opening. One bumper may optionally extend along substantially the entire length of the mattress.

The top opening 141 beneficially enables a user lying on the bed to access items beyond the bed. For example, a user can reach out across the opening 141 to an item on a nightstand, bed table, or the like (e.g., to access an alarm clock, food, beverage, adjustable bed control, other control, telephone, intercom button, etc.). Beneficially, the user is able to reach and access across the opening 141 without needing to deflate any of the inflatable bumpers 111 or 121. The user is therefore able to maintain accessibility of items nearby the top opening 141 without the need for continuous inflating and deflating of the bumpers. The access provided by the beneficial arrangement thereby avoids unnecessary wear and tear on the bumpers, air pump, and other components of the mattress cover 100 caused by a greater number of inflation/deflation repetitions.

In addition, a user is able to immediately reach and gain access to items across the opening 141 without having to wait for an obstructing rail to be deflated or otherwise removed. Further, the illustrated bumper arrangement provides access across the opening 141 without requiring deflation of the bumpers, which avoids a scenario where the user is unprotected from accidental rollovers off of the bed and falls from the bed. In many circumstances, such rollovers and falls occur because the user is reaching out across the bed. Typical bed rail systems obstruct desired access areas and make it difficult to reach and gain access to items near the upper portion of the side of the bed, often causing a user to remove or adjust the rails at the very moment protection is most needed. For example, a user may lower rails or deflate a bumper to make it easier to reach across and access a desired item. However, the act of reaching itself can cause the user to move to the side of the bed where the risk of fall is enhanced. Thus, at the very moment a rail or bumper is needed to prevent the fall, the rail or bumper has been made ineffective.

In contrast, where a user of the presently disclosed embodiment reaches across opening 141, the corresponding bumper stays inflated and maintains ability to prevent the user from falling off of the bed. Preferably, one or both of the bumpers 111 and 121 are positioned so that the upper opening 141 has a size sufficient to allow a patient to easily reach an arm out across the opening 141. For example, the bumper 121 may extend toward the head of the bed to a position below shoulder height of a patient lying on the bed. The bumper 121 then extends across the midsection of the side edge at a length roughly corresponding to the torso, hips, and thighs of the user, thereby protecting the bulk of the weight of the user from rollovers and falls while simultaneously providing sufficient accessibility through top opening 141.

The bottom opening 142 beneficially allows a user lying on the bed to pivot his/her legs around and off of the bed so that the user can sit up off of the bed. For example, a user may wish to sit up from a lying position and/or may wish to get up from the bed completely. The typical motion for getting out of a bed involves the user swinging his/her feet to one side of the bed and planting the feet on the ground near the foot of the bed as the user sits up. In a typical bed rail/bumper arrangement, the rails or bumpers extend to near the foot of the bed. When a user wishes to sit up, the user may be required to lower the rails or deflate the bumpers to make it easier to swing his/her legs across the edge of the bed. However, doing so removes the rail or bumper's ability to protect the user from falls in the very moment where the likelihood of such risks is enhanced. For example, a user wishing to sit up or get out of bed may lower rails or deflate bumpers at the very moment they are attempting to sit up and move toward the edge of the bed.

In preferred embodiments, the bumpers 111 and 121 are sized to extend to about the lower thigh area or knees of a user lying upon the bed. In this manner, the bumpers 111 and 121 are able to beneficially keep the bulk of the weight of the user from rolling over the edge of the bed while simultaneously allowing for opening 142 to allow the user to properly swing his/her legs out across the edge of the bed. The opening 142 therefore ensures that a user has his/her legs properly positioned feet first across the edge of the bed while sitting up, while simultaneously preventing the center of the body (upper thighs, hips, torso) from also sliding over the edge, causing a fall. Advantageously, the user is able to use the opening 142 to sit up and/or get out of bed without the necessity of deflating either of the bumpers 111 and 121.

Although the illustrated bumpers 111 and 121 have lengths that are shorter than the full length of the bed upon which they are positioned, it has been surprisingly found that such a configuration promotes safety to a greater degree than rails or bumpers positioned across a greater length of the side edges. Although it may appear that greater coverage from the rails or bumpers corresponds to greater protection, in practical application user needs require adjustment and movement of the rails and/or bumpers in a manner that actually makes overextended rails or bumpers less safe. It has been found that optimally positioning the bumpers 111 and 121 provides continuous rollover and fall protection, even with lower overall bumper lengths, without requiring frequent deflation and associated loss of user protection at times when it is likely needed most (such as when a user is reaching over or attempting to sit up).

Typically, the length of a mattress is about 74 to 80 inches. The preferred top opening 141 is sized within a range of about 6 to 30 inches, or about 12 to 24 inches. The typical bottom opening 142 is sized within a range of about 12 to 36 inches, or about 18 to 30 inches. The preferred length of the bumpers 111 and 121 is within a range of about 30 to 62 inches, or about 36 to 54 inches.

In the illustrated embodiment, inflation and deflation of the bumpers 111 and 121 are controlled by the pump system 104. The pump system 104 is operatively coupled to a control 105, which may be a user-operated control providing one or more buttons, dials, switches, touch-screen interfaces, and/or other controls for selecting and controlling the inflation and/or deflation of the bumpers 111 and 121.

The illustrated embodiment also includes a set of sleep position sensors 144 and 146 respectively disposed near the inflatable bumpers 111 and 121. The sleep position sensors 144 and 146 are positioned to determine whether a user is getting too close to the edge of the bed. The sensors 144 and 146 are operatively coupled to the pump system 104 to enable induced activation and/or deactivation of the corresponding bumper. For example, the bumpers may be configured to be in a deflated or partially inflated state by default, and to a greater degree upon a positive reading by the corresponding sensor indicating that the user has moved sufficiently close to a particular bumper to warrant greater inflation. In some embodiments, one or more of the bumpers 111 and 121 are configured to act as ramps such that when inflated, they function to encourage the user away from the edge and toward the center of the bed. For example, one or more of the bumpers 111, 121 may be shaped as a scalene triangle with a longer horizontal component than vertical component to create an effective but comfortable ramp structure when inflated.

In some embodiments, the control 105 also includes a communication control providing a user with the ability to communicate remotely with others. For example, the control 105 may include a "help" button or other selectable object to enable a patient to signal for help, to send a voice request, to notify caretakers that he/she would like to get out of bed, and the like. Two-way communication can also be enabled. For example, someone can remotely communicate with the patient (e.g., to respond to a previous communication from the patient or to initiate a conversation with the patient). As explained in more detail below, one or more components of the mattress cover device may be associated with a computer-implemented application that enables remote control over mattress cover functionality (see description of FIG. 3).

For example, communications and/or notifications may be sent from the control 105 to one or more relatives and/or caretakers and/or rescue workers having such an application on their corresponding computer device(s).

Figure 2:
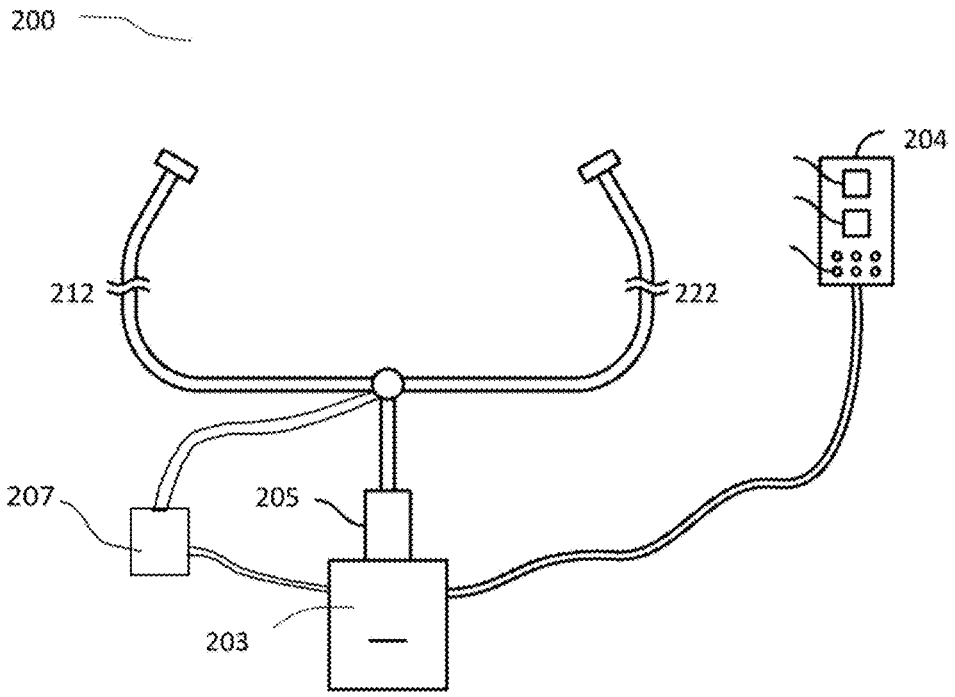
FIG. 2 illustrates pump system for controlling pumping of the bumpers.

FIG. 2 illustrates one embodiment of a pump system 200 that may be utilized with the mattress cover 100 or with other embodiments described herein. The illustrated pump system 200 includes a primary pump 203 (e.g., battery powered and/or powered through a wall outlet) and a control 204. The control 204 (which may be represent or may be configured similar to the control 105) is provided for selectively activating the primary pump 203 for adjustment of one or more of the operatively connected bumpers. The primary pump 203 may include one or more sensors 212, 222 for sensing the air pressure of each of the bumpers. In this embodiment, the sensors 212 and 222 are shown as in-line sensors. Other embodiments may position the sensors within the bumpers and/or in other suitable positions.

In one embodiment, when the air pressure of one or more of the bumpers is lower than a first threshold pressure, the primary pump 203 is activated. In response to the air pressure reaching a second threshold pressure, the primary pump 203 is deactivated. The second threshold pressure is a higher pressure than the first threshold pressure. The electric pump may further include a third threshold pressure. When a patient is in touch with one or more of the bumpers, the pressure of the bumper may increase. When the air pressure is higher than a third threshold pressure, the primary pump 203 may be activated to deflate the one or more bumpers, until the pressure of the one or more bumpers is lower to the second threshold pressure. The third threshold pressure is higher than the second threshold pressure.

In some embodiments, the pump system 200 is configured to beneficially maintain and/or increase pressure within the connected bumpers. In the illustrated embodiment, the pump system 200 includes a pressure-maintening secondary pump 207 that may operate and/or be operated independent of the primary pump. For example, the smaller secondary pump 207 can be configured to be smaller and/or quieter that the primary pump 203. Secondary pump 207 can be utilized to run more frequently than the primary pump 203 in order to generally maintain pressure within the bumper(s), while the larger primary pump 203 may be utilized during inflating and/or deflating operations to more effectively inflate and/or deflate the bumper(s).

This dual pumping system beneficially provides better control over inflation and deflation of one or more of the inflatable bumpers while also effectively providing a consistent and maintained level of inflation when one or more of the bumpers are in the inflated state. For example, relatively rapid inflation and deflation is beneficial in circumstances where a quick transition between one state or the other is desired, such as in circumstances where bumper inflation is actuated in response to a sensor detection in order to prevent a user from falling off of a bed. In another example, relatively rapid deflation may enable easier and faster separation of the bumpers and cover (e.g., for cleaning) and/or repositioning of the cover.

When a bumper is in the inflated state, the relatively quieter secondary pump 207 can be utilized to maintain sufficient inflation of the bumper. For example, rather than utilizing several intermittent on/off cycles of the primary pump 203, the pressure-maintaining secondary pump 207 can be activated as needed to maintain and/or increase pressure in the bumper. This arrangement more efficiently utilizes the separate pumps 203 and 207, which can save on energy costs, provide a less disruptive environment with less cycling of the primary pump 203 (which is particularly important in a sleep-associated setting in which the device is likely to be used), and reduce wear to the primary pump 203. In addition, the secondary pump 207 may extend the usable life of the associated bumpers by allowing effective use even as small air leaks appear over time. Further, because the inflation level of the bumpers is more consistently maintained at desired and intended levels, the associated safety effects provided by the bumpers is enhanced.

Although the foregoing example shows two separate pumps as the primary pump and the pressure-maintaining pump, it will be understood that other embodiments may include a single pump configured to provide the same functionality. For example, a single pump may be configured with bimodal capabilities that enable both lower pressure-maintaining activities and relatively rapid inflating/deflating activities. In other embodiments, more than two pumps may be utilized. For example, two pumps can be utilized for deliberate inflation/deflation actions, with the third pump acting as a pressure-maintaining pump. Alternatively, a first pump can function as the primary pump 203 to provide very fast inflation or deflation, a second pump can function as a relatively less forceful pressure-maintaining pump 207, and a third pump can function as an intermediate pump 205 to provide additional inflation/deflation capacity and/or pressure-maintaining ability as needed.

Although the illustrated pump system 200 is described in conjunction with inflation and deflation of the one or more inflatable bumpers, it will be understood that such a pump system can also be utilized for beneficial inflation/deflation and pressure maintenance of other inflatable structures, such as inflatable mattresses, inflatable play sets, and the like.

Figure 3:
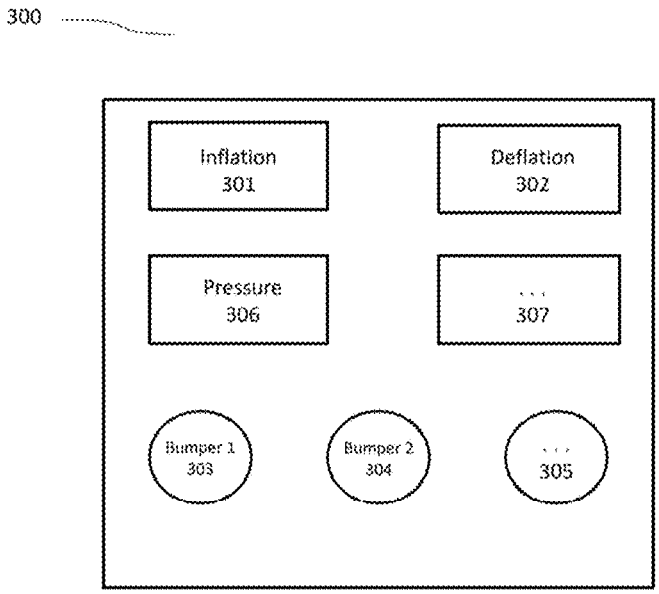
FIG. 3 illustrates an exemplary control for controlling the pumping system of the mattress guard.

FIG. 3 illustrates one embodiment of a control 300 that may be utilized with any of the mattress or mattress cover embodiments described herein. The illustrated control 300 includes an interface providing various user selectable objects, such as for providing an inflating and deflating function for each one of the bumpers, for providing notifications, bumper pressure status, and the like. For example, the illustrated control 300 has bumper selector buttons (i.e., user selectable interface objects) 303, 304, an inflation button 301, a deflation button 302, and a pressure button 306. The control 300 may also include additional functionality and/or controls, as indicated by the ellipses in the additional buttons 305,-307 (e.g., notification objects, timer settings, and the like). In some embodiments, the pressure control button 303 allows the user to set the desired threshold pressures of the bumpers or activate the air pressure control. When the air pressure control function is activated, the sensors 212 and 222 are activated. The pressure control function may activate the pump to inflate or deflate, or deactivate the pump to stop inflating or deflating.

In another embodiment, the control may include a touch screen that allows the user to interface with the various selectable objects of the control. In another embodiment, the control may also be a remote control. In another embodiment, the control may be a computer-implemented application. The computer may be a personal computer, a computer server, or a mobile device. A caretaker (e.g., relative, nursing home, or a hospital) may control the inflatable bumpers through the control.

In some embodiments, the functionality of the control may be provided by an application on a mobile device or other computing device. In such embodiments, the computer device on which the control is implemented may be communicatively linked to the pump system (such as pump system 200) so that manipulation and selection of control functions can be accomplished remotely. In some embodiments, the pump system is communicatively coupled to the control 300 via a wireless connection (e.g., Wi-Fi, Bluetooth, etc.). In some embodiments, the application is configured to provide remote alerts based on readings by one or more pressure sensors of the inflatable bed bumpers. For example, the application may be configured to enable the display of a current pressure reading in one or both of the inflatable bumpers (e.g., a simple "inflated" or "deflated" display, a high/medium/low display, and/or a more granular display showing actual units of pressure). In another example, the application may be configured to deliver an alert whenever an inflatable bumper is manually deflated (potentially indicating that a patient is trying to get out of bed and may need assistance or supervision), whenever an inflatable bumper becomes unexpectedly deflated (potentially indicating a malfunction, rupture, or mechanical issue), and/or whenever pressure becomes suddenly higher in one inflatable bumper or becomes higher relative to the opposite bumper (potentially indicating that the patient is positioned on or stuck against the higher pressure bumper).

As described above, the pump system may also be controlled remotely via the control 300. For example, where the control 300 is remotely linked to the pump system, a person can utilize the control to remotely inflate one or more of the inflatable bumpers and/or to perform other functions.

In some embodiments, the control includes a timer function. For example, a timer can be set so that one or more of the inflatable bumpers will remain deflated (or less inflated) for a period of time and will inflate at a predetermined time or after a predetermined amount of time has passed. In one example, children may want to play with or jump on the inflated bumpers, and so a timer may be set so that the guards do not inflate until a later time when the children are likely to be asleep.

Figure 4:
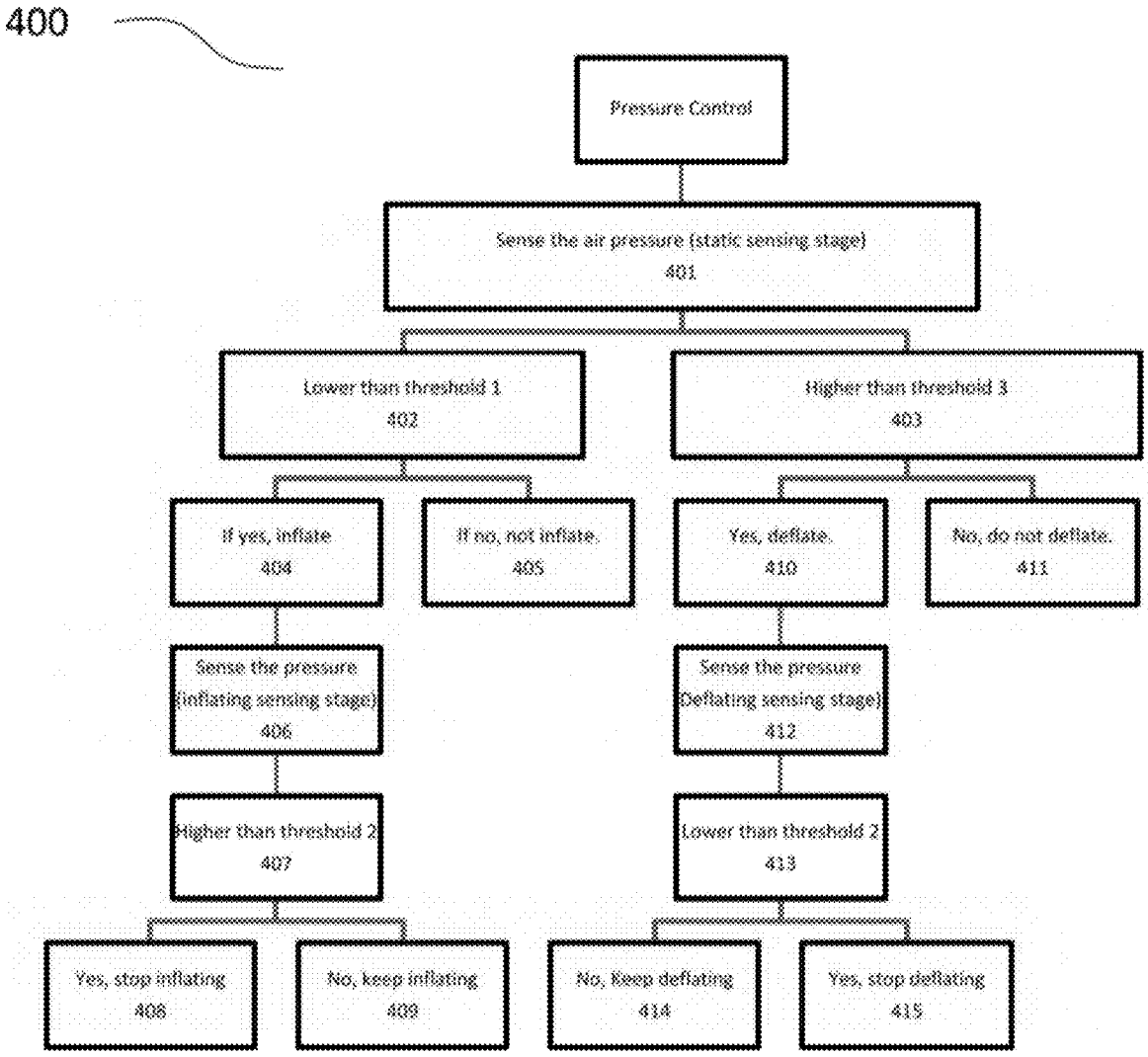
FIG. 4 illustrates a flow chart of an exemplary method for controlling the pressure of the bumpers, the method being implementable using a processer/controller of the pump system and/or the control coupled to the pump system.

FIG. 4 illustrates a flow chart of one pressure control method that may be utilized with the embodiments described herein. When the pressure control function is activated 400, the sensor is activated to sense the air pressure of the corresponding bumper (act 401). When the air pressure is lower than threshold 1 (determination 402), the air pump starts to inflate the bumper (act 404). While inflating, the sensor continues to sense the air pressure (act 406). When the air pressure reaches threshold 2 (determination 407), the pump stops inflating (act 408) and goes back to sensing stage 401. However, if the sensor sensing the air pressure (act 406) detects that the pressure is not higher than threshold 2 (determination 407), then the air pump will keep inflating (act 409). In embodiments having two or more independent pumps (or two or more pump modalities), such as the pumping system 200 shown in FIG. 2, each separate pump can operate according to its own respective pressure control method (e.g., each following the flow chart as outlined in FIG. 4 but having different threshold settings).

In some embodiments, the pressure control method can also include a third threshold determination (e.g., used to prevent overly inflated or overly stiff bumpers, and/or used to prevent damage to bumpers from overly high pressures). When the air pressure is higher than threshold 3 (determination 403), the air pump starts to deflate the bumper (act 410). While deflating, the sensor continues to sense the air pressure (act 412). When the air pressure reaches threshold 2 (act 413), the pump can either stop deflating (act 415) and go back to the static sensing stage 401 or, if the sensor senses the air pressure (act 412) and detects that the pressure is not lower than threshold 2 (act 413) then the sensor can signal the pump to keep deflating (act 414). When the air pressure is not lower than threshold 1 (determination 405), the pump does not inflate the bumper. When the air pressure is not higher than threshold 3, the pump does not deflate the bumper. Therefore, during the sensing stage 401, the pump will not be activated to inflate or deflate, as long as the sensed air pressure is between threshold 1 and threshold 3. The air pressure of threshold 3 is higher than threshold 1, and the air pressure of threshold 2 is higher than threshold 1.

In one embodiment, the air pressure sensor could also be used to determine whether the user is in contact with the bumpers. When a user moves from one side of the bed to the other side of the bed, and in contact with one or more bumpers, the pressure of the one or more bumpers changes. The change of the air pressure could indicate that the user is in contact with the one or more bumpers. This information can be passed to caretakers, family members, or others. For example, if a processer communicatively coupled to the pump system and/or control is informed by the sensor(s) that a pressure change has occurred for a threshold amount of time (indicating contact with a bumper for an extended amount of time), a signal or notification can be sent to caretakers or other interested parties.

Figure 5:
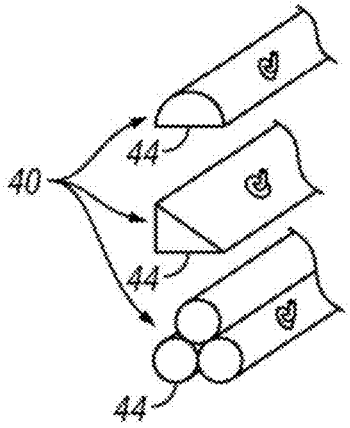
FIG. 5 illustrates embodiments of various shaped inflatable bumpers.

Bumpers utilized in mattress cover embodiments described herein may be formed in a variety of different shapes. FIG. 5 illustrates some exemplary embodiments of bumpers 40. In one embodiment, each of the bumpers has a flat surface 44 aligned, when the bumper is positioned within the pocket, along the top surface of the mattress. In another embodiment, one of the bumpers has a cross-sectional shape of a semicircle, triangle or pyramid. In one embodiment, a bumper has a cross-sectional shape of a right triangle.

Figure 6A:
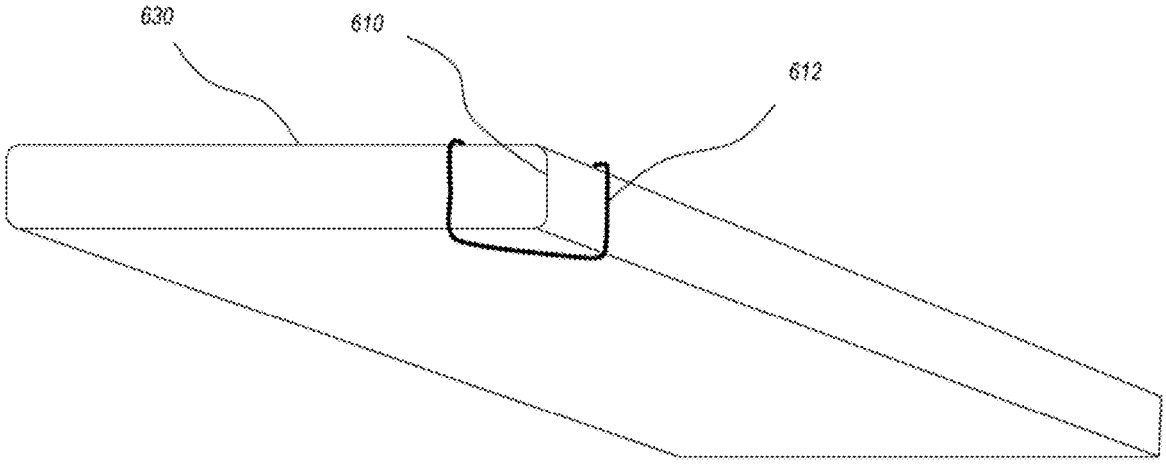
FIGS. 6A and 6B illustrated exemplary fastening mechanisms for fastening a mattress cover embodiment to a mattress.
Figure 6B:
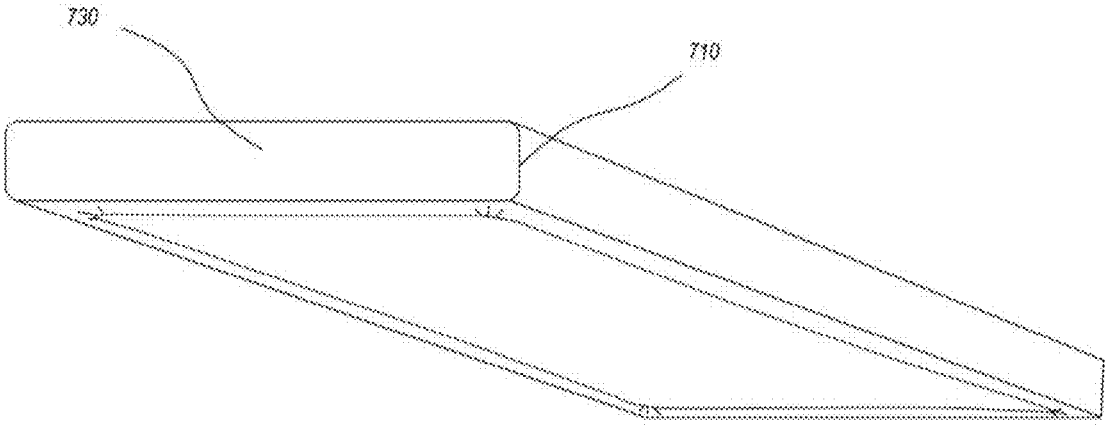

FIGS. 6A and 6B illustrate exemplary embodiments of sheet fastening mechanisms that may be utilized with any of the mattress cover embodiments described herein. In FIG. 6A, the fitted sheet 630 includes a strap 612 configured to pass across a corresponding mattress corner 610. In FIG. 6B, the fitted sheet 730 is formed with an overfit to position around the mattress corner 710, the corner portion of the sheet 730 held in place by an elastic component, drawstring, or the like to tighten the sheet 730 around the corner 710. Other embodiments may additionally or alternatively include one or more buckles, hook and loop fasteners, cinches, and/or other fastening mechanisms. In some embodiments, a mattress cover is configured to completely envelop a mattress. Such embodiments may include a zippered opening (e.g., along the top side portion or bottom side portion) to seal the mattress completely. In such embodiments, the bumpers are securely fixed in place, making the mattress guard effectively safe and stable.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. Any feature or component of a described embodiment may be combined with or substituted for any other feature or component of another described embodiment.

What is claimed is:

1. A guard system configured for use with a mattress, the guard system comprising:

a mattress cover configured to at least partially enclose the mattress, the mattress cover having a top edge, a bottom edge, and opposing first and second side edges which are each longer than the top edge and the bottom edge, wherein the top edge is positionable at a head of the mattress, the bottom edge is positionable at the foot of the mattress, and the first and second side edges are positionable along respective first and second sides of the mattress; and a total of two separate and non-contiguous inflatable bumpers, which are fixedly attached to the mattress cover, in which first and second separate and non-contiguous inflatable bumpers are each positioned along a corresponding first or second side edge, wherein the first inflatable bumper has a length that is greater than half but less than a full length of the first side edge, and wherein the first inflatable bumper is placed in and extends continuously along at least a midsection of the first side edge, the first inflatable bumper having a topmost extension that terminates short of the top edge to form a top opening between the topmost extension of the first inflatable bumper and the top edge of the mattress cover and a bottommost extension that terminates short of the bottom edge to form a bottom opening between the bottommost extension of the first inflatable bumper and the bottom edge of the mattress cover, the first inflatable bumper when inflated providing a top opening or passageway with a length in a range of about 6 to 30 inches to allow a user to access an object near the mattress without deflating the first inflatable bumper and a bottom opening or passageway with a length in a range of about 12 to 36 inches to allow the user to pivot the user's legs around to sit up on the mattress and/or to get off the mattress without deflating the first inflatable bumper, wherein the length of the top opening or passageway in the first inflatable bumper is less than the length of the bottom opening or passageway.

2. The mattress guard of claim 1, further comprising a pump system operatively coupled to the first and second inflatable bumpers to enable adjustment of inflation levels of the one or more inflatable bumpers.

3. The mattress guard of claim 2, wherein the pump system includes a primary pump having relatively greater flow capacity and a secondary pump having relatively lower flow capacity, the primary pump being configured for relatively rapid inflating and deflating of the first and second inflatable bumpers and the secondary pump being configured for substantially maintaining and/or increasing an inflation level of the first and second inflatable bumper.

4. The mattress guard of claim 1, wherein the second inflatable bumper has a length that is greater than half but less than a full length of the second side edge, and wherein the second inflatable bumper is placed in and extends across a midsection of the second side edge, the second inflatable bumper having a topmost extension that terminates short of the top edge to form a top opening with a length in a range of about 6 to 30 inches between the topmost extension of the second inflatable bumper and the top edge of the mattress cover and/or a bottommost extension that terminates short of the bottom edge to form a bottom opening with a length in a range of about 12 to 36 inches between the bottommost extension of the second inflatable bumper and the bottom edge of the mattress cover.

5. The mattress guard of claim 1, wherein the mattress cover further comprises one or more fastening members configured in size and shape to be positioned over a corner of the mattress upon which the mattress cover is positioned.

6. The mattress guard of claim 1, wherein the mattress cover further comprises a drawstring to tighten the mattress cover to the mattress.

7. The mattress guard of claim 1, wherein the first inflatable bumper has a length within a range of 36 inches to 62 inches.

8. The mattress guard of claim 1, wherein the second inflatable bumper is longer than the first inflatable.

9. The mattress guard of claim 1, wherein the height of the inflatable bumper is between 3 inches and 12 inches when fully inflated.

10. The mattress guard of claim 1, further comprising a control communicatively linked to the pump system configured to provide remote control of the pump system.

11. The mattress guard of claim 10, wherein the control is a computer-implemented application executable on a mobile device.

12. The mattress guard of claim 11, wherein the computer-implemented application is configured to receive and display a notification based on one or more sensor readings.

13. The mattress guard of claim 10, wherein the control includes a timer operation for setting a delayed inflation adjustment or a timed inflation adjustment.

14. A guard system configured for use with a mattress, the guard system comprising:

a cover configured to at least partially enclose the mattress, the cover having a top edge, a bottom edge, and opposing first and second side edges which are each longer than the top edge and the bottom edge, wherein the top edge is positionable at a head of the mattress, the bottom edge is positionable at the foot of the mattress, and the first and second side edges are positionable along respective first and second sides of the mattress;

a first inflatable bumper positioned along the first side edge and having a topmost extension that terminates short of the top edge to form a top opening or passageway between the topmost extension of the first inflatable bumper and the top edge of the cover and a bottommost extension that terminates short of the bottom edge to form a bottom opening or passageway between the bottommost extension of the first inflatable bumper and the bottom edge of the cover, and wherein the bottom opening or passageway is longer than the top opening or passageway;

a second inflatable bumper positioned along the second side edge; and a pump system operatively coupled to the first and second inflatable bumpers to enable independent adjustment of inflation levels of the first and second inflatable bumpers such that the first inflatable bumper can be inflated or deflated independent of the second inflatable bumper, the pump system including:

a primary pump having relatively greater flow capacity and being configured for relatively rapid inflating and deflating of the one or more inflatable bumpers;

a secondary pump having relatively lower flow capacity and being configured for substantially maintaining an inflation level of the one or more inflatable bumpers; and a sensor operable to detect changes in air pressure and determine whether a user is in contact with or near a bumper, the sensor being operably coupled to the pump system to actuate inflation of the bumper upon detecting that the user is in contact with or near the bumper.

15. The mattress guard of claim 14, wherein the second inflatable bumper is longer than the first inflatable bumper .

16. The mattress guard of claim 14, wherein the first inflatable bumper has a length within a range of 36 inches to 62 inches.

17. The mattress guard of claim 14, wherein the top opening or passageway has a length in a range of 6 to 30 inches.

18. The mattress guard of claim 14, wherein the bottom opening or passageway has a length in a range of 12 to 36 inches.

19. A safety mattress with inflatable safety bumpers, comprising:

a mattress having a top edge, a bottom edge, and opposing first and second side edges which are each longer than the top edge and the bottom edge; and first and second inflatable bumpers integrally formed with and separately inflatable relative to the mattress, each positioned along a corresponding first or second side edge, wherein the first inflatable bumper has a length that is greater than half but less than a full length of the first side edge, and wherein the first inflatable bumper is placed in and extends continuously along at least a midsection of the first side edge, the first inflatable bumper having a topmost extension that terminates short of the top edge of the mattress to form a top opening between the topmost extension of the inflatable bumper and the top edge and the first inflatable bumper having a bottommost extension that terminates short of the bottom edge of the mattress to form a bottom opening between the bottommost extension of the inflatable bumper and the bottom edge bumper, wherein the length of the top opening in the first inflatable bumper is less than the length of the bottom opening.

* * * * *